US008142233B2

(12) United States Patent
Niitsu

(10) Patent No.: US 8,142,233 B2
(45) Date of Patent: Mar. 27, 2012

(54) TERMINAL ASSEMBLY AND FLAT CABLE CONNECTOR

(75) Inventor: Toshihiro Niitsu, Tokyo (JP)

(73) Assignee: Molex Incorporated, Lisle, IL (US)

( * ) Notice: Subject to any disclaimer, the term of this patent is extended or adjusted under 35 U.S.C. 154(b) by 199 days.

(21) Appl. No.: 12/529,416

(22) PCT Filed: Mar. 3, 2008

(86) PCT No.: PCT/US2008/002806

§ 371 (c)(1),
(2), (4) Date: Nov. 17, 2009

(87) PCT Pub. No.: WO2008/109044

PCT Pub. Date: Sep. 12, 2008

(65) Prior Publication Data

US 2010/0075529 A1 Mar. 25, 2010

(30) Foreign Application Priority Data

Mar. 1, 2007 (JP) ..... 2007-051323

(51) Int. Cl.
*H01R 9/22* (2006.01)

(52) U.S. Cl. ..... 439/708

(58) Field of Classification Search ..... 439/885, 439/877, 708, 377
See application file for complete search history.

(56) References Cited

U.S. PATENT DOCUMENTS

| | | | | |
|---|---|---|---|---|
| 3,829,817 | A | 8/1974 | Beavitt | |
| 4,633,582 | A * | 1/1987 | Ching et al. | 29/827 |
| 4,740,867 | A * | 4/1988 | Roberts et al. | 439/67 |
| 4,743,080 | A | 5/1988 | Siraty | |
| 5,385,478 | A * | 1/1995 | Niekawa | 439/67 |
| 5,631,192 | A * | 5/1997 | Heppler et al. | 438/25 |
| 5,730,608 | A * | 3/1998 | Legrady | 439/885 |
| 6,113,438 | A * | 9/2000 | O'Sullivan | 439/885 |
| 6,171,149 | B1 * | 1/2001 | van Zanten | 439/885 |
| 6,478,612 | B2 * | 11/2002 | Okano | 439/67 |
| 6,595,796 | B1 * | 7/2003 | Koegel et al. | 439/77 |
| 6,764,336 | B2 * | 7/2004 | Ma et al. | 439/885 |
| 6,837,748 | B2 * | 1/2005 | Aldridge | 439/885 |
| 7,112,072 | B2 * | 9/2006 | Korsunsky et al. | 439/885 |
| 7,682,207 | B2 * | 3/2010 | Clark | 439/885 |

FOREIGN PATENT DOCUMENTS

JP 60-036809 9/1986

OTHER PUBLICATIONS

International Search Report for PCT/US08/002806.

* cited by examiner

*Primary Examiner* — Briggitte R Hammond
(74) *Attorney, Agent, or Firm* — Timothy M. Morella

(57) ABSTRACT

A connector for connecting together two ends of flat flexible cable includes a base member and a cover member. The base member has a plurality of slots that receive a corresponding number of conductive terminals. The terminals have two upward bends in them near their midpoint and these bends are spaced apart longitudinally along the terminals so as to mate with exposed ends of the lengths of flat cable. Two projections serve as press arms to retain a cover in place upon the base member. The cover exerts a pressure on the cable ends and the terminals to provide a reliable electrical contact between them.

20 Claims, 12 Drawing Sheets

TERMINAL ASSEMBLY AND FLAT CABLE CONNECTOR

BACKGROUND OF THE INVENTION

The present invention relates to a terminal assembly and a connector for connecting together two lengths of flat cables. A known connector for connecting flat cables, called flexible printed circuits, flexible flat cables, or the like, to each other, is shown in Japanese Utility Model Laid-Open Kokai Publication No. H5-31167. FIG. 20 is a perspective view of a conventional relay connector.

The relay connector includes a housing 806 formed of an insulative and a plurality of conductive terminals 807 held in the housing 806. The terminals 807 are accommodated within grooves formed between a plurality of holding tongues 811 formed in a bottom portion of the housing 806. The terminals 807 include latching openings 807*a*, and are fixed to the housing 806 by latching the latching openings 807*a* with latching projections 816 projecting from the holding groove.

End portions of a pair of flat cables 801 are accommodated in the housing 806 and each such cable 801 includes a plurality of conductive leads 803 formed on one surface (bottom surface in the drawing) of a body 802, and an insulating film which covers surfaces of the leads 803. At the end portions of the cables 801, the insulating films are removed, and the conductive leads 803 are exposed. Positioning holes 818 are formed in the cables 801, and projections 813 formed in the housing 806 are engaged with these positioning holes 818 so the cables 801 are accommodated in the housing 806.

Meanwhile, a cover body 809 is movably attached to the housing 806, and when the cover body 809 is closed, the end portions of the pair of cables 801 are held in the housing 806 and a pressure body 814 attached to the inner surface of the cover body 809 presses against the flat cables 801. Therefore, the conductive leads 803 of the flat plate-shaped cable 801 are pressed against connecting projections 807*b* and the leads 803 and terminals 807 are connected.

Nevertheless, because the flat cables 801 are positioned by the engagement of the housing projections 813, the structure of the becomes complex and increases in size. In recent years, electronic parts are becoming increasingly more miniaturized, and flat cables 801 are narrower, and their leads 803 have smaller pitches, and it is difficult to form positioning holes 818 in the body 802 of the narrow flat cables 801 as well as form the projections 813 in the housing 806. Of course, it may be possible to position the cable 801 by allowing the outer side edge of the cable body 802 to contact the inner side surface of the connector housing 806, but because the dimensional accuracy of the cable body 802 is generally low, the positional accuracy of the inner side surface of the housing 806 relative to the terminals 807 cannot be increased, and the positioning accuracy of the cable 801 is reduced.

SUMMARY OF THE INVENTION

It is therefore a general object of the invention to solve the problems of the conventional terminal, and to provide an terminal assembly and connector, which includes terminals parallel to each other at a predetermined pitch, a pair of frame members extending longitudinally and terminal holding members which hold the terminals, the frame members, even if the pitch is narrow, manufacturing becomes easy and requires a shorter time, the array of the terminals can be maintained accurately, positioning accuracy of the terminals and the frame members is high, conductive leads of flat plate-shaped cables are guided by the frame members, and the flat plate-shaped cables can be positioned with high accuracy.

Therefore, an terminal assembly according to the present invention includes frame members, a plurality of terminals arrayed so as to be in parallel with each other at a predetermined pitch, and terminal holding members connected to the frame members and hold the terminals, wherein the frame members comprise a pair of members provided on both outer sides of the terminals in an array direction of the terminals and extending in parallel with each other, and perform positioning of each counterpart terminal and each of the terminals by guiding the counterpart terminals, and the terminal holding members are connected at their both sides in a longitudinal direction thereof to the frame members and hold proximal end portions of the terminals.

In another embodiment of the terminal assembly, the frame member is provided with a guide portion for guiding the counterpart terminals located on both outermost positions in an array direction of the counterpart terminals, and the frame members make it possible to position the counterpart terminals in the array direction by bringing outer side surfaces of the counterpart terminals positioned on the outermost positions into contact with inner side surfaces of the guide portions.

In a still further embodiment of the terminal assembly, each of the terminals is provided with the proximal end portions located on both ends thereof in a longitudinal direction thereof, and held by the terminal holding members, and an elastically deformable arm portion connecting the both proximal end portions, and the arm portion comprises upwardly projecting angular projections connected to the proximal end portions, respectively, and a connecting portion connecting the angular projections, the projections coming into contact with the counterpart terminals.

In a yet further embodiment of the terminal assembly, the terminal holding members are members formed from an insulating material and covering the proximal end portions of the terminals, and at least a part of the frame members adjacent to both ends.

A connector according to the present invention includes a housing, frame members, a plurality of terminals arrayed so as to be in parallel with each other at a predetermined pitch, and terminal holding members connected to the frame members and hold the terminals, wherein the frame members comprise a pair of members provided on both outer sides in an array direction of the terminals and extending in parallel with each other, and perform positioning of a pair of flat plate-shaped cables in a width direction thereof by guiding counterpart terminals of the flat plate-shaped cables, and the terminal holding members are connected at their both ends in a longitudinal direction thereof to the frame members and hold proximal end portions of each of the terminals and fixed to the housing.

In another embodiment of the connector further includes a lid member which is attached to the housing, covers a top surface of the housing, and holds the flat plate-shaped cables.

In a further embodiment of the connector, the housing is provided with a flat plate-shaped base plate portion, terminal accommodating recessed portions formed in the base plate portion and accommodates the frame members and the terminals, a pair of terminal holding member accommodating grooves formed in the terminal accommodating recessed portion and accommodate the terminal holding members, and a pair of engaging projections, and each of the engaging projections is provided with an overhang portion which projects inward and comes into contact with side edge portions of the flat plate-shaped cables, and a lid latching portion which projects outward and is engaged with each engaging opening of the lid member.

In a still further embodiment of the connector, the frame members is provided with guide portions for guiding counterpart terminals located at both outermost positions in an array direction of the counterpart terminals, and the frame members make it possible to position flat plate-shaped cables in a width direction by bringing outer side surfaces of the counterpart terminals positioned at the outermost positions into contact with inner side surfaces of the guide members.

In a yet further embodiment of the connector, each of the terminals is provided with proximal end portions located at both ends thereof in a longitudinal direction thereof and held by the terminal holding members, and an elastically deformable arm portion connecting the both proximal end portions and the arm portion is provided with upwardly projecting angular projections connected to the proximal end portions, respectively, and a connecting portion connecting the angular projections, and the angular projections coming into contact with the counterpart terminals of each of a pair of flat plate-shaped cables and hold the flat plate-shaped cables in cooperation with the lid member, allowing the pair of flat plate-shaped cables to be electrically connected to each other.

According to the present invention, the terminal assembly includes terminals arrayed so as to be in parallel with each other at a predetermined pitch, a pair of frame members which extend in the longitudinal direction of the terminals in parallel with each other, and terminal holding members for holding the terminals and the frame members. Therefore, even if the pitch is narrow, manufacturing of the terminal assembly is done easily and in a short time, the array of the terminals can be maintained accurately, positional accuracy of the terminals and the frame members is high, conductive leads of a flat plate-shaped cables are guided by the frame members, and the flat plate-shaped cables can be positioned with high accuracy.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DESCRIPTION OF THE PREFERRED EMBODIMENTS

Figure 1:
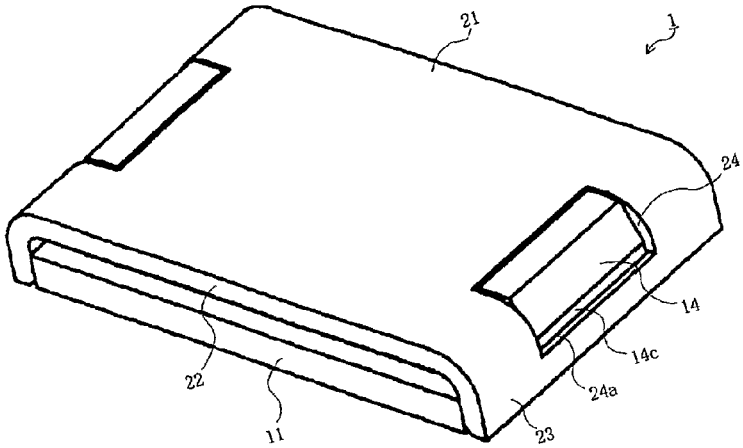
FIG. 1 is a perspective view of a connector constructed in accordance with the principles of the present invention.

In the Figures, a relay connector 1 is shown that is used to connect together flat cables 101. The cables 101 are commonly referred to in the art as flexible printed cable (FPC) or a flexible flat cable (FFC), but it may be any type of cable as long as it is flat or plate-shaped and has conductive leads. The connector 1 includes a housing 11 formed from an insulative material, and a flat cover member 21 having a plate-like shape that is also formed of an insulative material and a plurality of conductive terminals 61. The cover member 21 is attached to the housing 11 in a detachable manner and it covers the top surface of the housing 11 as well as fixes and holds a pair of flat cables 101 in place.

Figure 2:
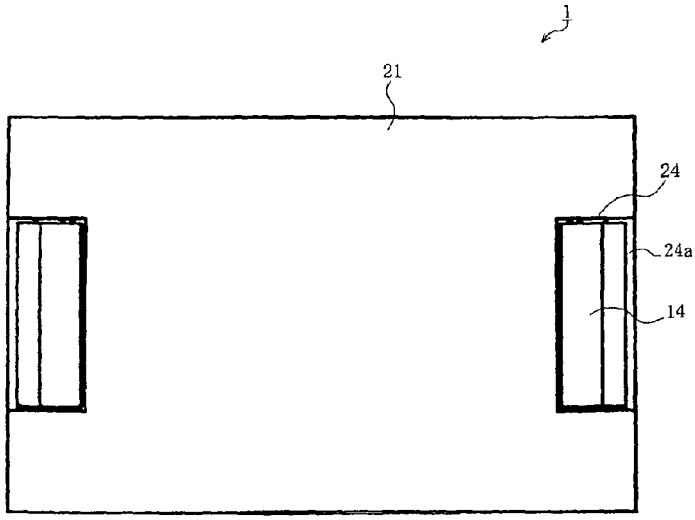
FIG. 2 is a top plan view of the connector of FIG. 1.
Figure 3:
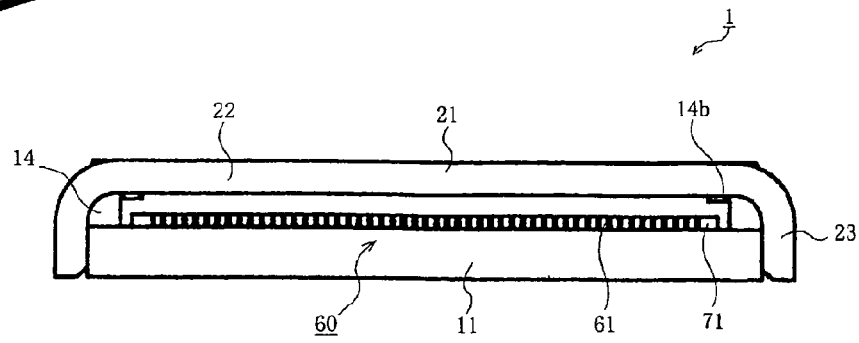
FIG. 3 is a front elevational view of the connector of FIG. 1.
Figure 4:
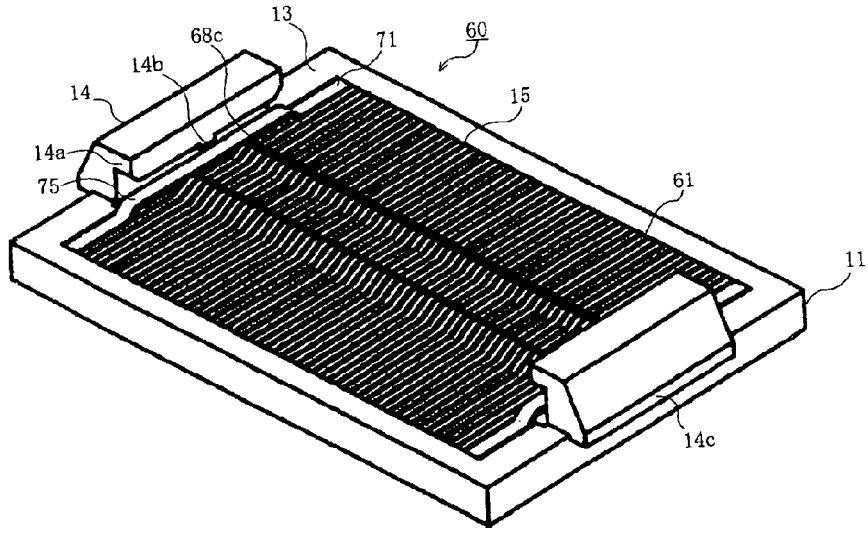
FIG. 4 is the same view as FIG. 1, but with the cover member removed for clarity.
Figure 5:
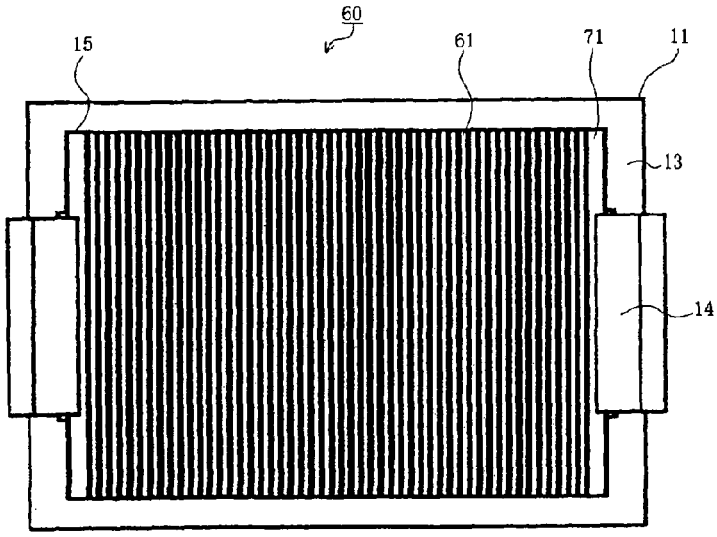
FIG. 5 is a top plane view of the connector body of FIG. 4.

The cover member 21 (FIG. 3) is provided with a flat cover portion 22 which has an approximately rectangular shape, leg sections 23 integrally connected to both ends of the cover portion 22 and which extend so as to be orthogonal to the cover portion 22, and engaging openings 24 formed in portions which connects the cover portion 22 and the leg sections 23 together. It has an overall U-shaped configuration. The openings 24 engage with the engaging projections 14 of the housing 11, so that the cover member 21 latches to the housing 11. By allowing a latching side surface 24*a* which defines one side of the leg section 23 in the opening 24 to be latched by a latching portion, or shoulder, 14*c* of the engaging projection 14, the cover member 21 latches to the housing 11 as shown in FIGS. 1-3.

Figure 7:
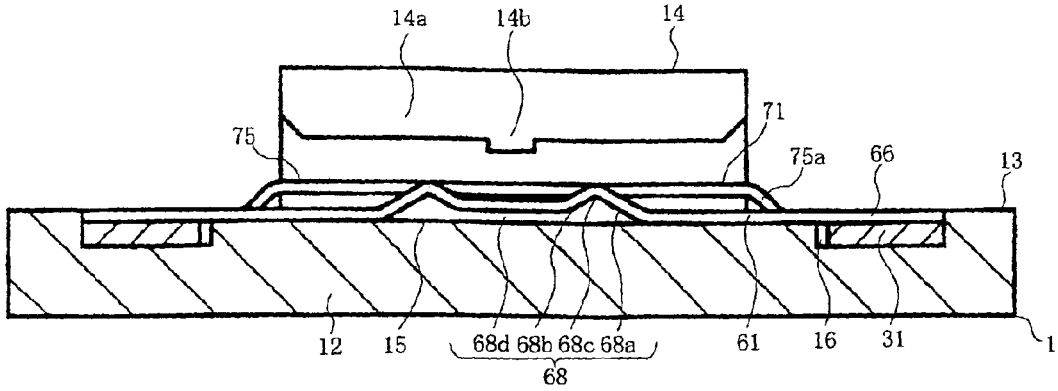
FIG. 7 is a cross-sectional view of the connector of FIG. 6, taken along line Z-Z therein.
Figure 8:
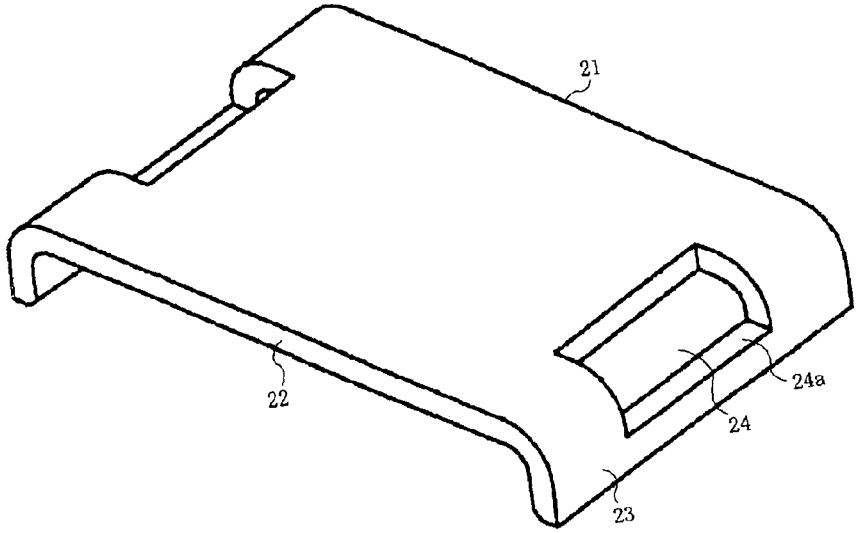
FIG. 8 is a perspective view of the cover member of the connector of FIG. 1.

As shown in FIG. 7, the connector housing 11 has a flat plate base plate portion 12 of approximately rectangular shape, a side wall portion 13 which forms a rectangular frame when viewed from above, a pair of engaging projections 14, a central terminal accommodating recessed portion 15 surrounded by the side wall portion 13, and a pair of terminal holding member accommodating grooves 16 formed in the terminal accommodating recessed portion 15. (FIG. 7.) Here, the side wall portion 13 is made of two pairs of straight walls that extend along the four sides of the base plate portion 12 and define the periphery of the base plate portion 12.

Figure 6:
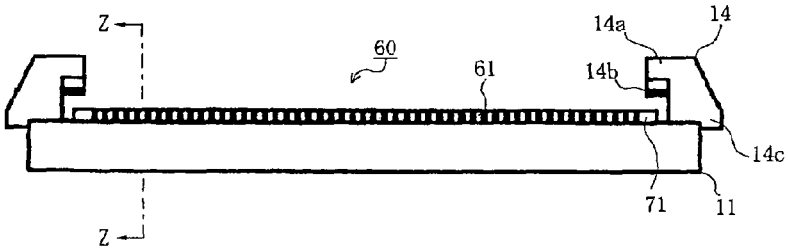
FIG. 6 is a front elevational view of the connector of FIG. 5.

The engaging projections 14 of the connector housing are integrally connected to the top surfaces of one pair of the walls of the side wall portion 13. Each engaging projection 14 is provided with an overhang portion 14*a* projecting inwardly toward the center of the connector housing at the top end of the engaging projection 14 (FIG. 6), a cable positioning projection 14*b* formed on the bottom surface of the overhang portion 14*a*, and the cover latching portion 14*c* projecting outwardly along the bottom surface. The bottom surface of the overhang portion 14*a* contacts the side end portions on the back surfaces of the flat cables 101 connected to the connector 1, preventing the flat cables 101 from shifting upward. The cable positioning projections 14*b* contact the end edges of the flat cables 101 on the connector 1, thus positioning the flat cables 101 in the extending direction.

Further, the terminal accommodating recessed portion 15 is a shallow rectangular recess which is slightly recessed from the top surface of the sidewalls and accommodates the terminal assembly 60. The depth of the terminal accommodating recessed portion 15 is approximately the same as the thickness of the terminals 61 as shown in FIG. 7.

The terminal holding member accommodating grooves 16 extend transversely and along the front and rear ends of the connector housing. These grooves 16 accommodate terminal holding members 31 which integrally hold proximal end portions 66 of the terminals 61.

Each terminal 61 is an elastic long, thin strip-shaped member formed from an elastic metal plate, and the terminals 61 are arranged so that they extend in a direction along the shorter side of the housing 11, in other words, in a direction in which the pair of opposed straight line-shaped portions of the side wall portion 13 without the engaging projections 14 extends, are arrayed in the longitudinal direction of the housing 11 and in parallel with each other at a predetermined pitch (for example, 100 [m] or smaller), and are attached to the terminal accommodating recessed portion 15 of the housing 11. The terminal 61 has a shape in which the front and back portions thereof in the longitudinal direction are symmetric. The terminals 61 are linear symmetric with respect to a straight line that is orthogonal to the longitudinal direction of the terminal 61 at the center of the longitudinal direction. In other words, the terminals extend lengthwise of the connector between the front and rear ends thereof as shown in FIG. 7.

As shown in FIG. 7, each terminal 61 comprises proximal end portions 66 which are held by the terminal holding members 31 formed from an insulative, and an arm portion 68 which extends from the proximal end portions 66 towards the center of the terminal 61 in the longitudinal direction, and connects the both proximal end portions 66, and the side surface thereof has an upwardly projecting angular shape. The arm portion 68 is provided with a pair of first slope portions 68*a* which are connected to the proximal end portions 66 on both sides, respectively, a pair of second slope portions 68*b* which are bent at a predetermined angle with respect to the first slope portions 68*a*, and a pair of bent portions 68*c* as connecting portions between the first slope portions 68*a* and the second slope portions 68*b*, and further, a connecting portion 68*d* connected to the ends of the second slope portions 68*b* on both sides is provided.

Here, the proximal end portions 66 extend in parallel with the top surface of the terminal accommodating recessed portion 15 and are in contact with the top surface of the same, and further, the first slope portions 68*a*, the second slope portions 68*b*, and the bent portions 68*c* form angular projection shapes which project higher than the proximal end portions 66, and, furthermore, the connecting portion 68*d* extends in parallel with the top surface of the terminal accommodating recessed portion 15, and connect the angular projections on both sides. Note that the connecting portion 68*d* is not in contact with the top surface of the terminal accommodating recessed portion 15, and is located with a distance above the top surface of the same. Moreover, the angle of the bent portion 68*c*, in other words, the angle formed by the first slope portion 68*a* and the second slope portion 68*b* which are bent at the bent portion 68*c*, can be set as appropriate, but approximately 120 degree is preferred.

When the flat cables 101 are connected to the connector 1, the bent portions 68*c* of each terminal 61 function as contact portions which come into contact with conductive leads 151 of the flat cables 101 and conduct electricity. The flat cables 101 are pressed toward the base plate portion 12 of the housing 11 by the overhang portions 14*a* of the engaging projections 14 and the cover portion 22 of the cover member 21 so that the flat cables 101 are pressed downward, and the bent portions 68*c* are pressed by the conductive leads 151, and shifted downward. Here, since the terminals 61 is formed from an elastic metal plate, the bent portions 68*c* generate a repulsive force as springs by being shifted downward, and are pressed against the conductive leads 151 by the repulsive force. Therefore, contact between the bent portions 68*c* and the conductive leads 151 is maintained without fail, and thus electrical conduction between them can be ensured.

When the bent portions 68*c* are shifted downward, the lengths of the arm portions 68 increase in the longitudinal direction in view of its shape. Accordingly, since the connecting portion 68*d* deflects downward, it provides a resistance when the bent portions 68*c* are moved downward. In other words, by connecting the bent portions 68*c* by the connecting portion 68*d* which is located above the top surface of the terminal accommodating recessed portion 15 without being in contact with the top surface, the contact between the bent portions 68*c* and the conductive leads 151 are enhanced appropriately.

Further, the terminal holding members 31 are members connected to the proximal end portions 66, covering the proximal end portions 66 from the bottom by a forming method such as overmolding, and have a thin and long rectangular shape which extend longitudinally along the housing 11, and integrally hold areas of all the proximal end portions 66 arrayed in the longitudinal direction. The portions of the terminal holding members 31 lower than the proximal end portions 66 are accommodated in the terminal holding grooves 16. The terminal holding members 31 are adhered to the bottom surfaces and the like of the terminal holding grooves 16 by adhesion means such as an adhesive. Therefore, the proximal end portions 66 are held by the housing 11 via the terminal holding members 31.

Furthermore, the terminal holding members 31 integrally hold the frame members 71 arranged on both outer sides of the terminals 61 in the array direction of the terminals 61. The frame members 71 extend parallel to the terminals 61 and are thin and long strip-shaped members formed from a metal plate, the portions of the frame member 71 adjacent to the both ends thereof in the longitudinal direction are held by the terminal holding members 31, and accommodated in the terminal accommodating recessed portion 15. Similarly to the proximal end portions 66 of the terminals 61, the portions of the frame members 71 adjacent to both ends thereof in the longitudinal direction extend in parallel with the top surface of the terminal accommodating recessed portion 15 and come into contact with the top surface of the same. In addition, although the frame members 71 extend in parallel with the top surface of the terminal accommodating recessed portion 15, each of the frame members 71 is provided with a cable guide portion 75 as a guide portion located above the top surface. The cable guide portion 75 has a dimension which fits the overhang portion 14*a* of the engaging projection 14 relative to the longitudinal direction, and both ends of the cable guide portion 75 are connected to the portions of the frame member 71 adjacent to both ends thereof via slope portions 75*a*. Note that, in the example shown in FIG. 7, the height of the top surface of the cable guide portion 75 is approximately the same as the peak surfaces of the bent portions 68*c* of the terminals 61. In addition, the angles of the slope portions 75*a*, in other words, the angles formed by the slope portions 75*a* and the top surface of the terminal accommodating recessed portion 15 can be set as appropriate, but approximately 45 degrees is preferred.

Here, a distance between the inner surfaces of the frame members 71 on both sides is approximately equal to a distance between outer side surfaces of the conductive leads 151 located at the both outermost positions in the width direction of the flat plate-shaped cables 101. Therefore, when the flat cables 101 are connected to the connector 1, by bringing the outer side surfaces of the conductive leads 151 located at the both outermost positions in the width direction of the flat cables 101 into contact with the inner side surfaces of the cable guide portions 75 on both sides, the flat cables 101 can be positioned so that the position of each conductive lead 151 in the array direction meets the position of the corresponding terminal 61. In other words, the locations of the outer side surfaces of the conductive leads 151 on the outermost sides on both sides in the width direction of the flat cables 101 meet the positions of the inner side surfaces of the cable guide portions 75 on both sides, so that each conductive lead 151 is positioned in the array direction.

Next, a method for manufacturing the connector 1 is described.

Figure 9:
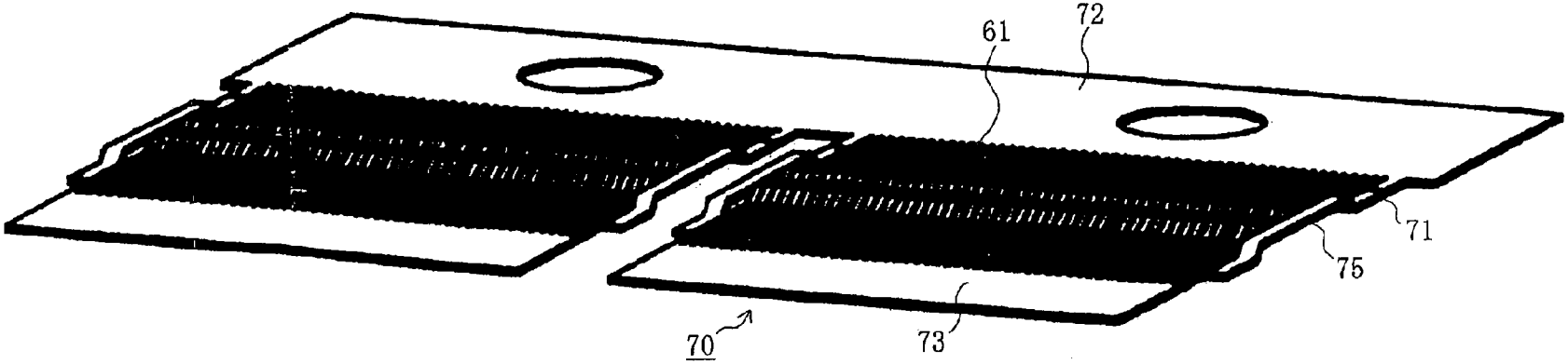
FIG. 9 is a perspective view of a carrier strip with two terminal preforms.
Figure 10:
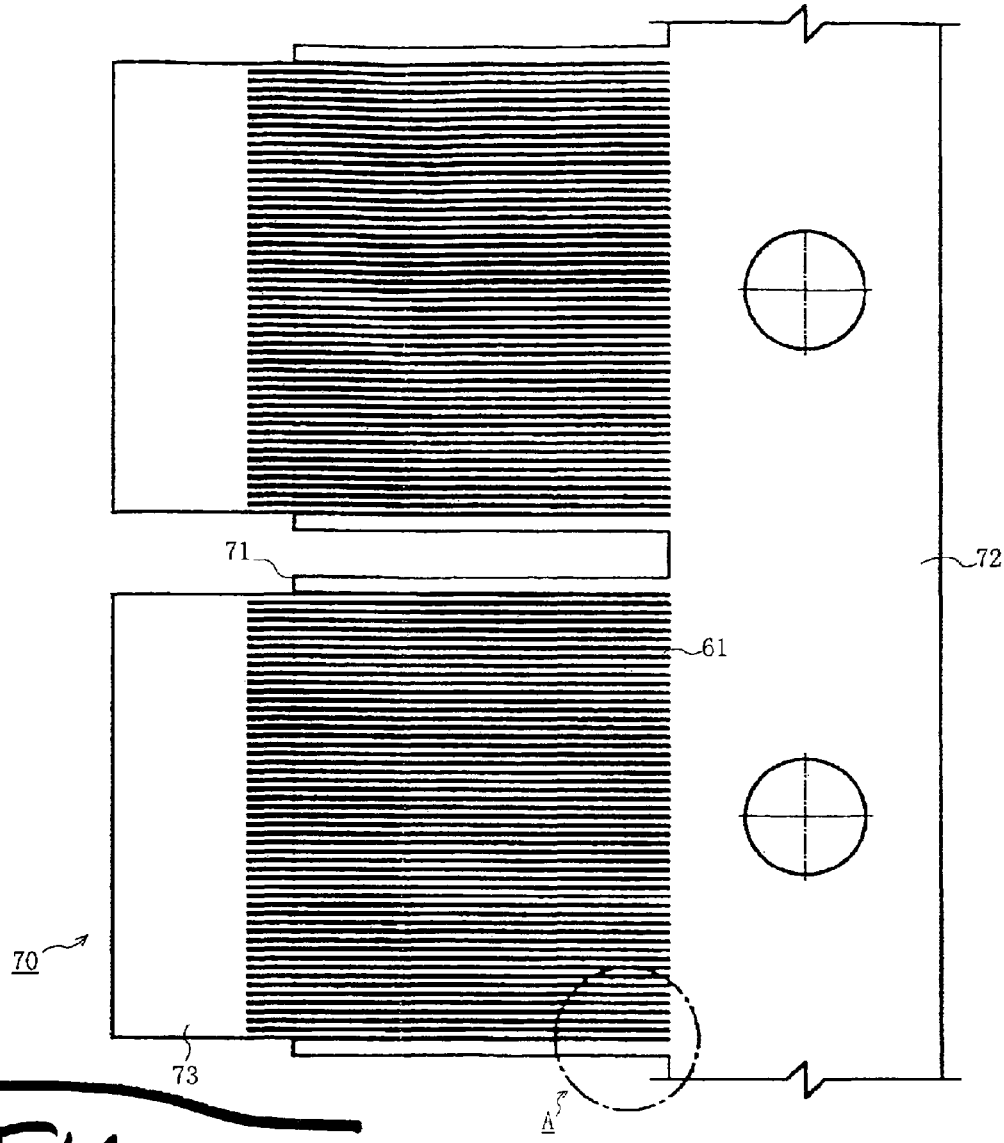
FIG. 10 is a top plan view of the terminal preform of FIG. 9.
Figure 11:
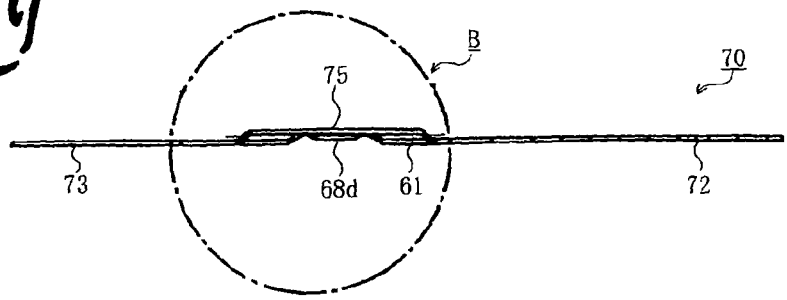
FIG. 11 is a side elevational view illustrating the terminal preform.
Figure 12:
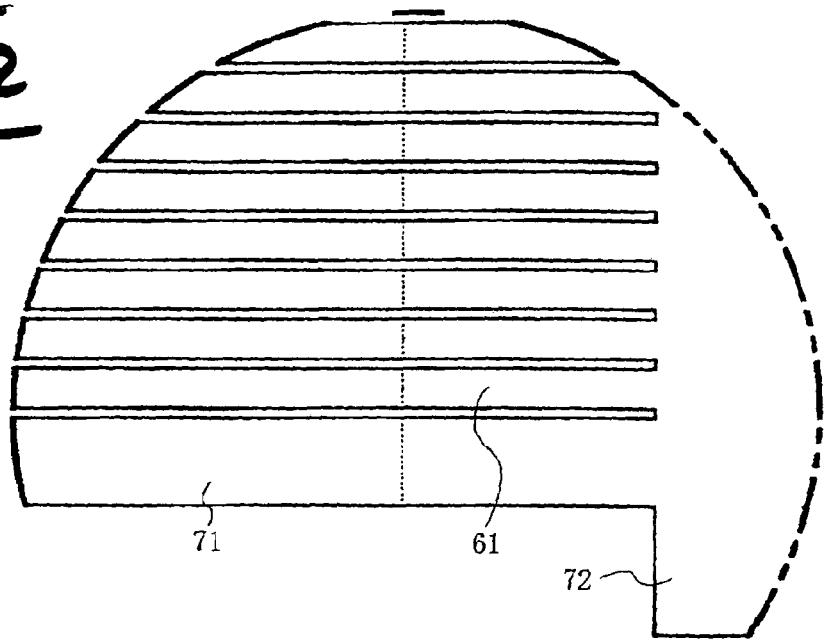
FIG. 12 is a partially enlarged detail view of the area "A" of the terminal preform in FIG. 10.
Figure 13:
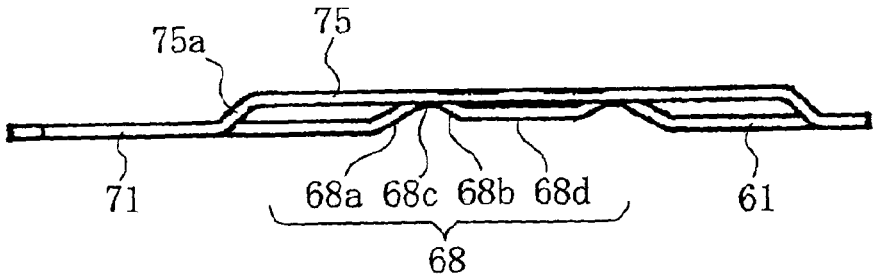
FIG. 13 is an enlarged detail view of the terminal preform at area "B" of FIG. 11.

First of all, by stamping and bending a conductive metal plate by using a machine tool such as a pressing device, a terminal preform member 70 as shown in FIGS. 9 and 10 is formed. The terminal preform member 70 may be formed in any kind of processing method, for example, laser processing and etching.

The terminal preform member 70 includes a pair of frame members 71 which extend in parallel with each other, and a plurality of terminals 61 arrayed so as to be in parallel with the frame members 71 and in parallel with each other at a predetermined pitch. The frame members 71 and the terminals 61 are members which are formed from the same metal plate.

Here, a plate-shaped carrier portion 72 is integrally connected to one ends of the terminals 61 and the frame members 71 in the longitudinal direction. The carrier portion 72 is a member which is gripped by a conveying machine, a machine tool, a tool, a jig, a hand of an operator, and so forth in order to easily perform such works as carrying and positioning the terminal preform member 70 in the manufacturing process of the connector 1 or the terminal assembly 60, and the carrier portion 72 is cut away at the final stage of manufacturing.

Note that, in the example shown in the drawings, two terminal preform members 70 are connected to the carrier portion 72. However, only one terminal preform member 70 may be connected to the carrier portion 72, or, if the carrier portion 72 is a long strip-shaped plate member, three terminal preform members 70 or more may be arrayed in parallel and connected to the carrier portion 72.

Further, a plate-shaped sub-carrier portion 73 is integrally connected to the other ends of the terminals 61 in the longitudinal direction. The sub-carrier portion 73 is formed integrally from the same metal plate as the terminals 61, and extends in the direction orthogonal to the terminals 61, in words, the array direction of the terminals 61. Note that, in the example shown in the drawings, the sub-carrier portion 73 is not connected to the frame members 71, but may be connected to the frame members 71 as necessary.

Furthermore, bending is performed for each terminal 61, and thus formed are the first slope portions 68*a* which are inclined relative to the proximal end portions 66, the second slope portions 68*b* which are bent at a predetermined angle relative to the first slope portions 68*a*, the bent portions 68*c* which connect the first slope portions 68*a* and the second slope portions 68*b*, and the connecting portion 68*d* which is connected to the ends of the second slope portions 68*b* on both sides. Similarly, bending is performed for each frame member 71, and thus formed are the cable guide portion 75, and the slope portions 75*a* which connect the cable guide portion 75 to the portions adjacent to both ends.

Next, the terminal holding members 31 formed integrally from an insulating material such as synthetic resin are fabricated as shown in FIG. 7 in parts of the terminal preform member 70 by forming method, for example, overmolding. The terminal holding members 31 are members formed to cover, from the bottom, portions of the proximal end portions 66 adjacent to both ends thereof in the longitudinal direction of all terminals 66 arranged in the array direction, and portions of the frame members 71 adjacent to both ends the of the frame members 71 provided at both outer sides of the terminals 61 arranged, and have a thin and long rectangular parallelepiped shape extending in the array direction of the terminals 61. In this case, it is preferred that the terminal holding members 31 have a thickness dimension which is approximately the same as the depth of the terminal holding member accommodating groove 16, in other words, the recess amount from the top surface of the terminal accommodating recessed portion 15. Thus, the proximal end portions 66 of the terminals 61 and the portions adjacent to both ends of the frame members 71 can maintain a linear shape without being deformed in the vertical direction on the top surface of the terminal accommodating recessed portion 15 and on the terminal holding member accommodating grooves 16.

Finally, by cutting away portions of the terminals 61 and the frame members 71 which are connected to the carrier portion 72 and the sub-carrier portion 73, and by removing the carrier portion 72 and the sub-carrier portion 73, the terminal assembly 60 can be obtained. Note that the terminals 61 and the frame members 71 can be cut by, for example, laser beam machining where target members are cut by laser beam irradiation, but any type of machining may be used. Therefore, each of the terminals 61 becomes a long and thin independent strip-shaped member which continues from one end to the other. In this case, all terminals 61 are held while at least the bottom portions of the proximal end portions 66 are covered by the terminal holding members 31. Further, both end portions of the terminal holding members 31 in the longitudinal direction are connected to the frame members 71 on both sides. Therefore, each of the terminals 61 are held by the terminal holding members 31 while maintaining a state where the terminals 61 extend in the longitudinal direction of the frame members 71, and are arrayed in the shorter direction of the frame members 71, and in parallel with each other at a predetermined pitch.

The terminal assembly 60 manufactured as above includes the frame members 71, the plurality of terminals 61 parallel with each other at a predetermined pitch, and the terminal holding members 31 which are connected to the frame members 71 and hold the terminals 61. The frame members 71 are formed from parallel pieces and the terminals 61 are provided between the frame members 71, and the terminal holding members 31 are connected to the portions adjacent to both ends of the frame members 71 in the longitudinal directions at the both ends thereof in the longitudinal direction, and hold the portions adjacent to both ends of the proximal end portions 66 of the terminals 61.

As described above, the terminal assembly 60 is manufactured by forming a terminal preform member 70 which includes the pair of frame members 71, and the terminals 61 which extend in the longitudinal direction of the frame members 71, are arrayed in the shorter direction of the frame members 71 and in parallel with each other at a predetermined pitch, connected integrally to the frame members 71 via the carrier portion 72, and connected to each other by the sub-carrier portion 73, by forming the terminal holding members 31 which integrally hold the frame members 71 and the terminals 61 by using forming method such as overmolding, and finally by removing the carrier portion 72 and the sub-carrier portion 73 so that the terminals 61 become separated and independent from each other. Hence, the frame members 71 and all the terminals 61 can be formed integrally, and manufactured easily and in a short time. Moreover, even if the pitch of the terminals 61 is as small as 100 [m] or smaller, the array of the terminals 61 can be maintained accurately.

Similarly, the positional relationship between the terminals 61 and the frame members 71 can be maintained accurately. Therefore, when the distance between the inner side surfaces of the frame members 71 on both sides is set to a value which is approximately the same as the distance between the outer side surfaces of the conductive leads 151 located on the outermost sides on both sides of the width direction of the flat cable 101, by placing the outer side surfaces of the conductive leads 151 located on the outermost sides on both sides of the width direction of the flat cable 101 along the inner side surfaces of the cable guide portions 75 on both sides, the flat cables 101 can be accurately positioned so that the position of each conductive lead 151 in the array direction contacts a respective terminal 61.

Finally, the cover member 21 can be attached to the housing 11 and the connector 1 shown in FIGS. 1 to 3 is obtained by providing the terminal assembly 60 in the terminal accommodating recessed portion 15 of the housing 11, adhering the terminal holding members 31 accommodated in the terminal holding grooves 16 to the bottom surfaces of the grooves 16 by way of an adhesive, and engaging the openings 24 of the cover member 21 with the engaging projections 14 of the housing 11, as shown in FIGS. 4 to 7.

Figure 14:
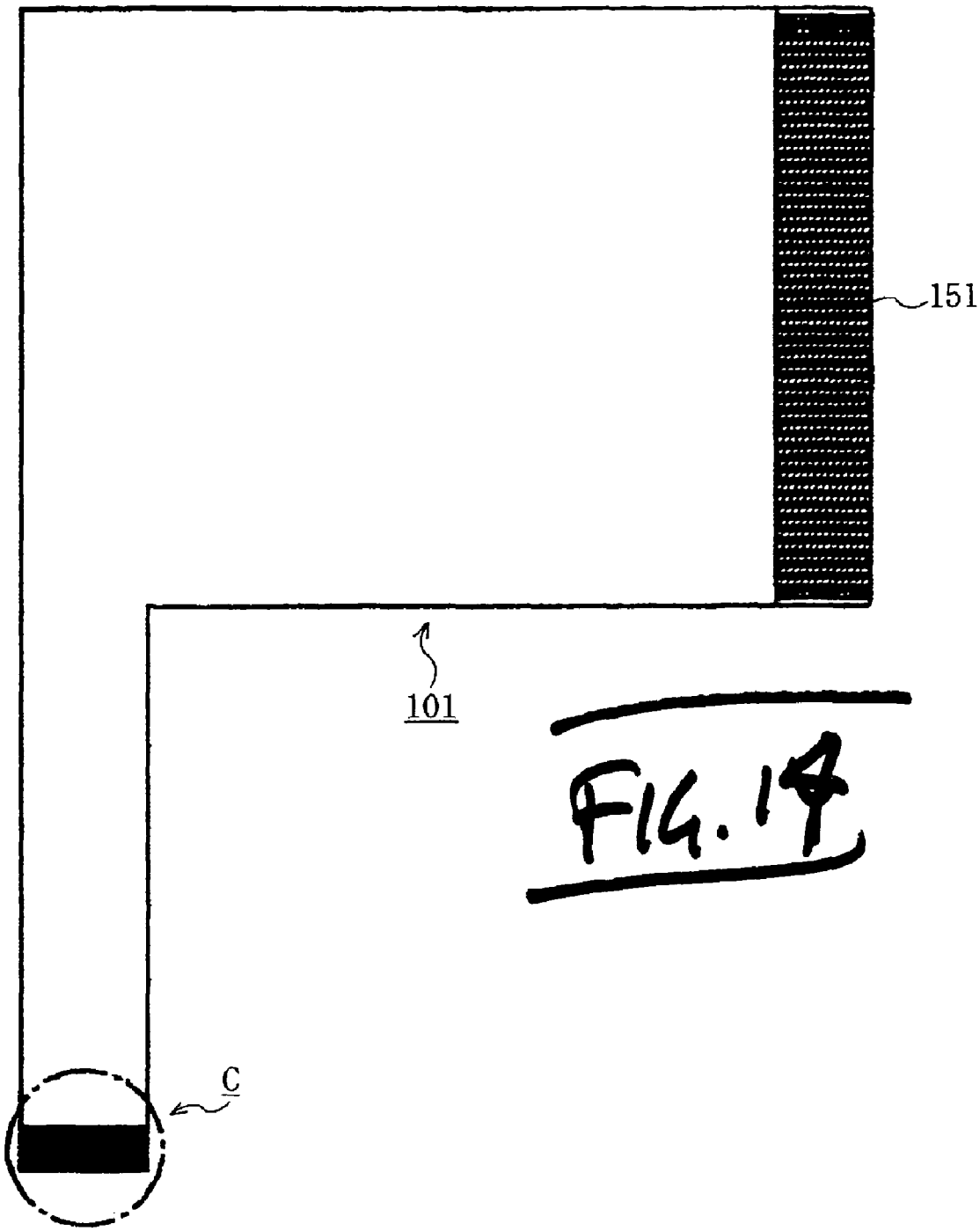
FIG. 14 is a plan view of a flat cable used in connectors of the present invention.
Figure 16:
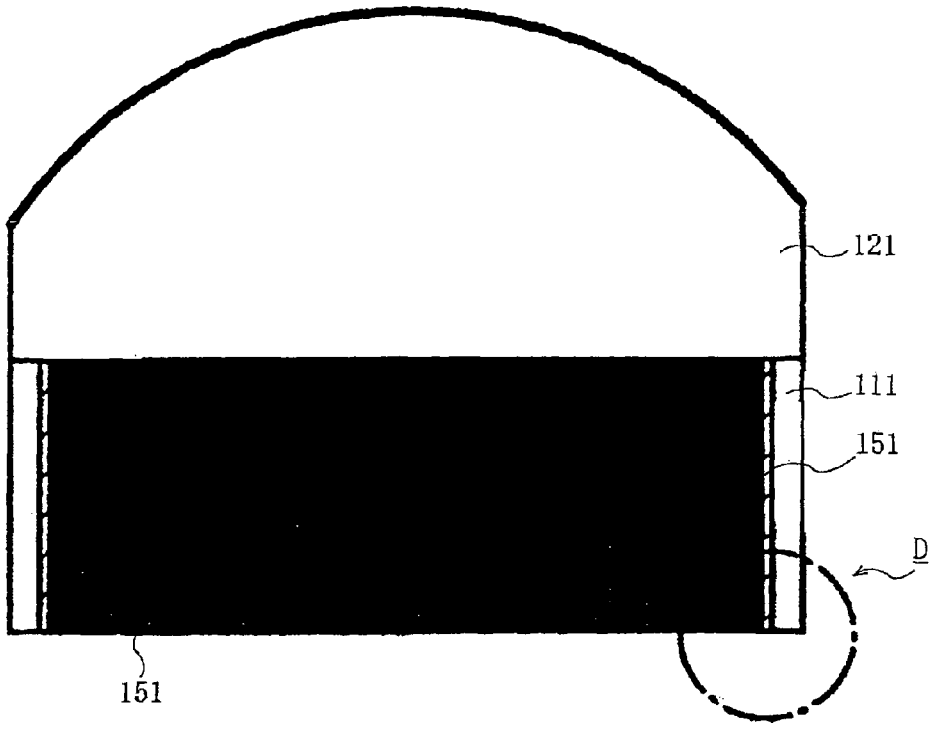
FIG. 16 is an enlarged view of a first main part of the flat cable of FIG. 14, which includes the area "C" of FIG. 14.
Figure 15:
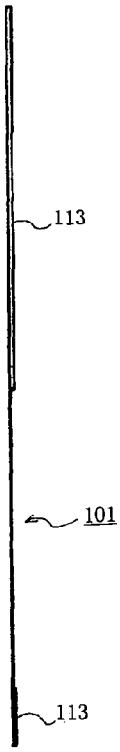
FIG. 15 is a side elevational view of the cable of FIG. 14.

Next, the connecting of the flat cable 101 to the connector 1 is described. In FIG. 14, the flat cable 101 has an approximate L-shape where the cable is bent at almost right angle in the middle of the longitudinal direction, and the width dimension changes at the bent portion, but any shape may be used. The flat cable 101 may have a linear strip shape, and may have the consistent width dimension.

The flat cable 101 includes a base plate portion 111 which is an insulating thin plate member, and conductive leads 151 arrayed on one surface of the base plate portion 111. The conductive leads 151 are, for example, foil-like linear bodies made from copper or the like, and are formed on the base plate portion 111 with some thickness, and arrayed in parallel with each other at a predetermined pitch, for example, about 100 [m].

Figure 17:
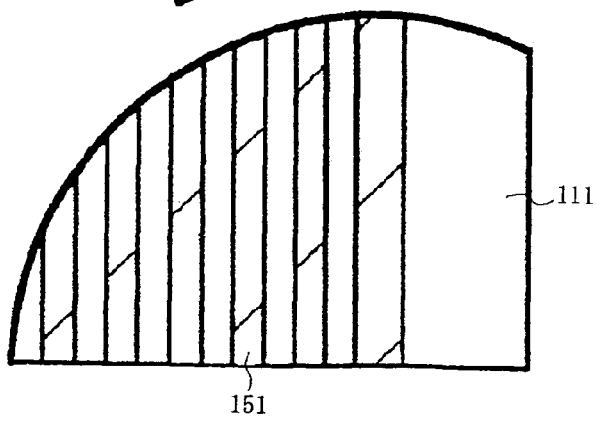
FIG. 17 is an enlarged view of area "D" of FIG. 16.

The top sides of the conductive leads 151 are covered with an insulating layer 121 and the areas of the ends of the flat cable 101 have the insulating layer 121 is removed to expose surfaces of the conductive leads 151. The exposed portions of the conductive leads 151 at one end of the flat cable 101 (lower end shown in FIG. 14) function as counterpart terminals which contact the bent portions 68*c* of the terminals 61. As shown in FIG. 17, although the width of the conductive lead 151 provided on the outermost side (the right side in the drawing) in the array direction of the conductive leads 151 is shown wider than the width of the other conductive leads 151, the width of conductive lead 151 provided on the outermost side may be changed as appropriate, and may be the same as the width of the other conductive leads 151.

Moreover, in an area in the flat cable 101 with a predetermined length from both ends, a reinforcing plate 113 is applied to the side opposite to the side where the conductive leads 151 are exposed, in other words, the back side of the base plate portion 111. Note that the area where the reinforcing plate 113 is applied is set wider than the area where the conductive leads 151 are exposed.

Figure 18:
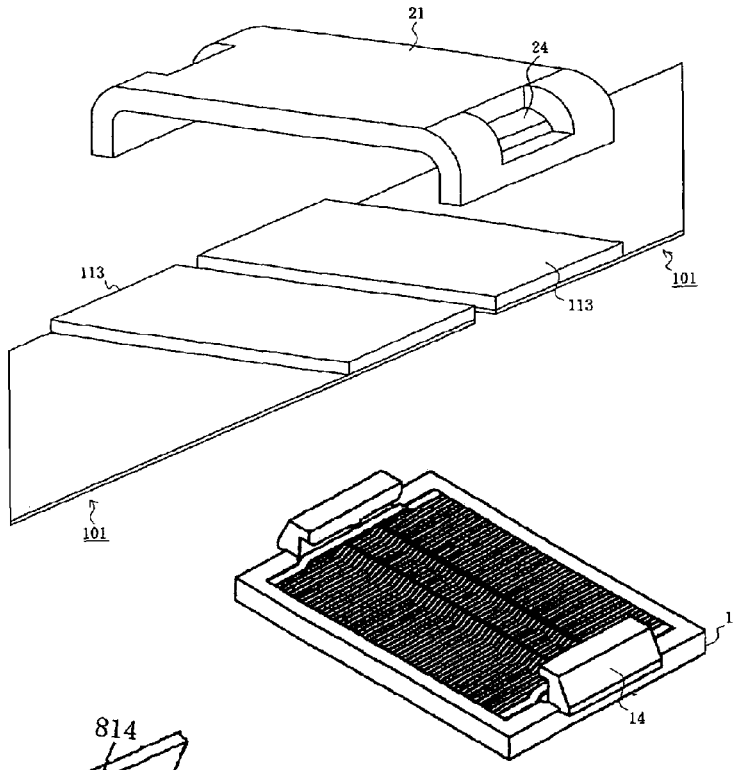
FIG. 18 is an exploded perspective view of the connector of FIG. 1, before the flat cables are connected.
Figure 20:
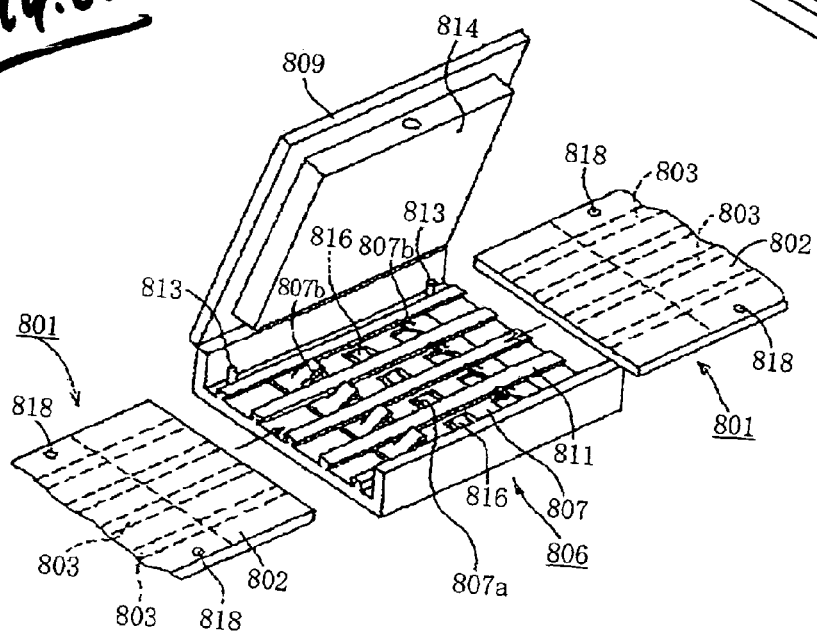
Figure 20:
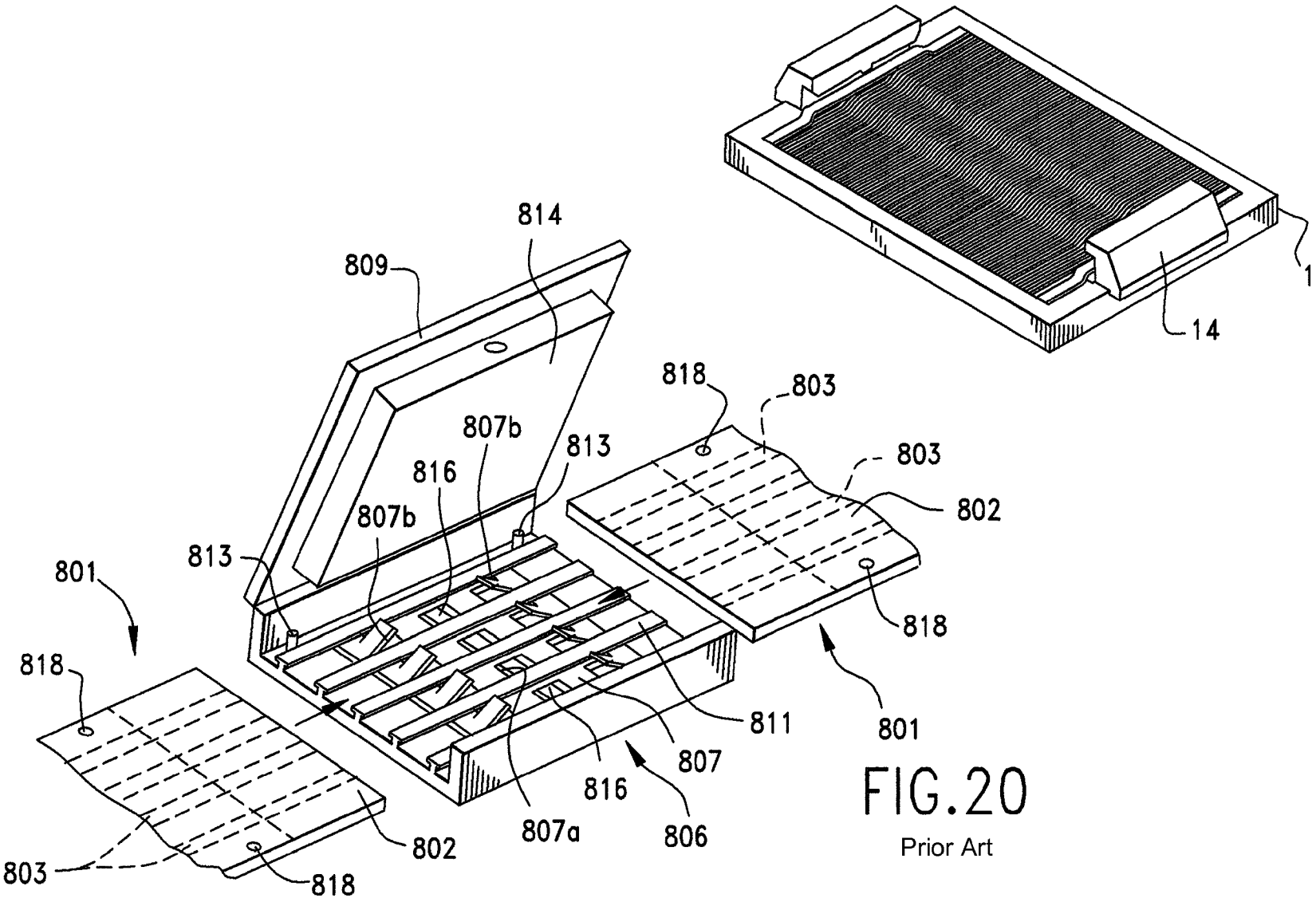
FIG. 20 Prior Art

When connecting the flat cables 101 to the connector 1, the cover member 21 is removed from the housing 11 as shown in FIG. 18. Thereafter, the attitude of the flat plate-shaped cables 101 are adjusted, and one ends of the flat cables 101 are positioned so that the conductive leads 151 exposed at one ends of the flat cables 101 face the base plate portion 12 of the housing 11, and the direction in which the conductive leads 151 extend matches the direction in which the terminals 61 extend.

For example, in FIG. 18, the flat cable 101 to be connected to the upper right side portion of the housing 11 is positioned above the terminals 61 so that the longitudinal direction of the end portion thereof becomes oblique, and the end thereof is directed towards the lower left. Also, for example, the flat cable 101 to be connected to the lower left side portion of the housing 11 in FIG. 18 is positioned above the terminals 61 so that the longitudinal direction of the end portion thereof becomes oblique, and the end thereof is directed toward upper right.

Next, the base plate portion 111 on both sides of the width direction at the end of the flat cable 101 is inserted between the overhang portions 14*a* of the engaging projections 14 and the cable guide portions 75 of the frame members 71. In this case, a portion of the base plate portion 111 to be inserted between the overhang portion 14*a* and the cable guide portion 75 is a portion located at the outer sides than the conductive leads 151 provided at the outermost positions in the array direction of the conductive leads 151, in other words, a portion located on the more right side than the conductive lead 151 located at the most right side in FIG. 17.

Further, the outer side surfaces which are formed by the thickness of the conductive leads 151 located at the both outermost positions in the width direction of the flat cable 101 are brought into contact with the inner side surfaces of the both cable guide portions 75 by using the thickness of the conductive leads 151. Therefore, the flat cables 101 can be positioned so that the positions of the conductive leads 151 in the array direction thereof match the positions of the corresponding terminals 61.

Generally, dimensional accuracy of the base plate portion 111 which is an insulating thin plate member is relatively low, and therefore, when, for example, the both side surfaces of the base plate portion 111 in the width direction are used for positioning, it is difficult to accurately position the flat cables 101 having the conductive leads 151 at a fine pitch of approximately 100 [m]. On the other hand, since dimensional accuracy of the conductive leads 151 is relatively high, the outer side surfaces of the conductive leads 151 located on the outermost positions are used for positioning as stated earlier in this embodiment, and the outer side surfaces are placed along the inner side surfaces of the cable guide portions 75 on both sides. Hence, the flat cables 101 can be positioned with high accuracy, allowing the positions of the conductive leads 151 in the array direction thereof to meet the positions of the corresponding terminals 61 accurately.

Since the slope portions 75*a* in the cable guide portions 75 are located on the outer side of the bent portions 68*c* relative to the insertion direction of the flat cables 101, the conductive leads 151 allow the inner side surfaces of the cable guide portions 75 to be located along the outer side surfaces of the conductive leads 151 located on the outermost sides before the bent portions 68*c* and the conductive surfaces of the conductive leads 151 come into contact with each other.

As explained above, in order to allow the cable guide portions 75 to be located along the outer side surfaces of the conductive leads 151 first, the cable guide portions 75 may be raised to be slightly higher than the bent portions 68*c*. This is effective when the slope portion 75*a* and the bent portion 68*c* are at an approximately same location in the insertion direction.

Furthermore, by allowing the tip edges of the flat cables 101 to come into contact with the cable positioning projections 14*b* formed on the bottom surfaces of the overhang portions 14*a*, positioning is done in the extending direction of the flat cables 101, in other words, in the extending direction of the conductive leads 151. Hence, the areas of the flat plate-shaped cables 101 with a predetermined length from the ends thereof in which the conductive leads 151 are exposed can correspond to the bent portions 68*c* of the terminals 61.

Figure 19:
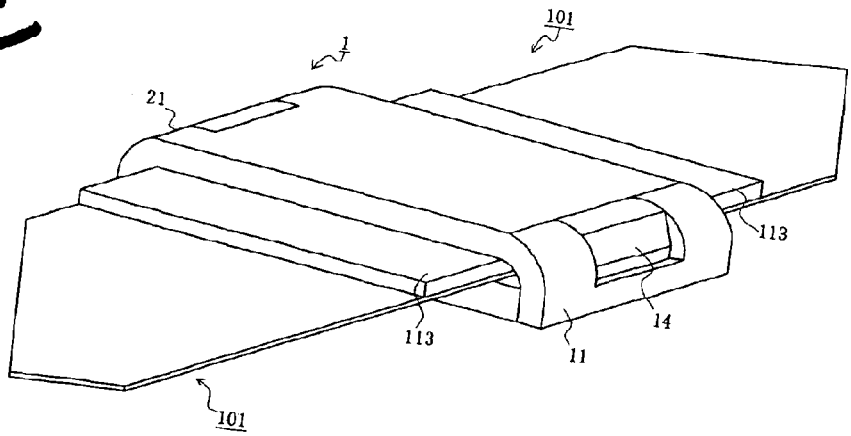
FIG. 19 is the same view as FIG. 18, but with the cables connected in the assembled connector; and, FIG. 20 is a perspective view of a conventional relay connector.

Next, as shown in FIG. 19, the cover member 21 is attached to the housing 11 from the top. In this case, the engaging openings 24 of the cover member 21 are engaged with engaging projections 14 of the housing 11, and thus the cover member 21 is latched by the housing 11. In this state, the surface of the cover portion 22 of the cover member 21 which faces the base plate portion 12 of the housing 11, in other words, the bottom surface, becomes almost flush with the bottom surfaces of the overhang portions 14*a*, and the flat plate-shaped cables 101 are pressed towards the base plate portion 12 of the housing 11, in other words, downward. Therefore, the bent portions 68*c* of the terminals 61 are pressed by the corresponding conductive leads 151 and shifted downward. Thereafter, by being moved downward, the bent portions 68*c* generate a repulsive force as springs due to the elasticity thereof, and are pressed against the conductive leads 151 by the repulsive force. This ensures contact between the bent portions 68*c* and the conductive leads 151, securing electrical conduction.

Moreover, since the bent portions 68*c* sandwich the flat cables 101 together with the cover portion 22 of the cover member 21 using the repulsive force of the bent portions 68*c* as springs, ensuring that the flat cables 101 are held, and are never detached from the connector 1.

As described so far, when the flat cables 101 are connected to the upper right portion and lower left portion of the connector 1, respectively, the conductive leads 151 of each of the flat cables 101 and the terminals 61 are electrically connected, and therefore, the conductive leads 151 of the both flat cables 101 are electrically connected to each other via the terminals 61.

Hence, in this embodiment, the frame members 71 are provided on both outer sides in the array direction of the terminals 61, formed from a pair of members extending in parallel with each other, and position each conductive lead 151 and each terminal 61 by guiding the conductive leads 151, and the terminal holding members 31 are connected to the frame members 71 at both ends in the longitudinal direction thereof, and hold the proximal end portions 66 of the terminals 61.

Therefore, even if the pitch of the terminals 61 is narrow, it becomes possible to achieve the terminal assembly 60 and the connector 1 in which manufacturing thereof is done easily and in short time, the array of the terminals 61 can be maintained accurately, the positional accuracy of the terminals 61 and the frame members 71 is high, the conductive leads 151 are guided by the frame members 71, and the flat cables 101 can be positioned highly accurately. Further, the pitch of the terminals 61 can be narrower, and the height dimensions of the terminal assembly 60 and the connector 1 can be reduced. Furthermore, the terminal assembly 60 and the connector 1 can be manufactured easily and at lower cost, and can be miniaturized.

Yet further, the frame members 71 are provided with the guide portions 75 which guide the conductive leads 151 located on the both outermost positions in the array direction of the conductive leads 151, and enable the conductive leads 151 to be positioned in the array direction by locating the outer side surfaces of the conductive leads 151 located on the outermost positions along with the inner side surfaces of the guide portions 75 on both sides. Therefore, instead of the base plate portion 111 with lower dimensional accuracy, the outer side surfaces of the conductive leads 151 with higher dimensional accuracy can be used for positioning, and thus positioning of the flat cables 101 can be conducted highly accurately, and the positions of the conductive leads 151 in the array direction can be met with the positions of the corresponding terminals 61 accurately.

Moreover, each of the terminals 61 is provided with the proximal end portions 66 which are located on both ends in the longitudinal direction and held by the terminal holding members 31, and the arm portion 68 which connects the proximal end portions 66 on both sides and is elastically deformable, and the arm portion 68 is provided with upwardly projecting angled projections connected to the proximal end portions 66, respectively, and the connecting portion 68*d* which connects the projections on both sides, and the projections come into contact with the conductive leads 151. Hence, the arm portions 68 generate a repulsive force as springs due to elasticity thereof, and since the projections are pressed against the conductive leads 151 by the repulsive force, the contact between the projections and the conductive leads 151 is maintained without fail, ensuring electrical conduction therebetween.

Moreover, the cover member 21 is attached to the housing 11 in a detachable manner, covers the top surface of the housing 11, and holds the flat cables 101. Therefore, due to the repulsive force generated by the arm portions 68 as springs, the arm portions 68 sandwich the flat plate-shaped cables 101 in cooperation with the cover portion 22 of the cover member 21 in the vertical direction, ensuring that the flat cables 101 are held, thus preventing the cables from being detached from the connector 1.

The present invention is not limited to the above-described embodiment, and may be changed in various ways based on the gist of the present invention, and these changes are not eliminated from the scope of the present invention.

The invention claimed is:

1. A terminal assembly, the terminal assembly comprising:

frame members;

a plurality of terminals, each terminal being arrayed in parallel with each other at a predetermined pitch; and terminal holding members, the terminal holding members being connected in a longitudinal direction thereof to the frame members for integrally holding proximal ends of the plurality of terminals, the proximal ends being located at both ends thereof in a longitudinal direction;

wherein each frame member includes a pair of members, each member being disposed on an outer side of the plurality of terminals in an array direction of the plurality of terminals and extending in parallel with each other, the pair of members being able to perform positioning of a plurality of counterpart terminals with the terminals by guiding the terminals.

2. The terminal assembly according to claim 1, wherein the frame member is provided with guide portions for guiding the counterpart terminals, located at the outermost positions, in an array direction of the counterpart terminals.

3. The terminal assembly according to claim 1, wherein the proximal ends are held by the terminal holding members.

4. The terminal assembly according to claim 1, wherein the terminal holding members are members formed from an insulating material.

5. A connector, the connector comprising:

a housing, the housing including:

a plurality of frame members;

a plurality of terminals supported by the housing, each terminal being arranged in parallel with each other at a predetermined pitch; and terminal holding members, the terminal holding members being connected at both ends longitudinally to the frame members for integrally holding proximal ends of the plurality of terminals so as to fix them to the housing, the proximal ends being located at both ends thereof in a longitudinal direction;

wherein each frame member:

comprises a pair of members, each member being disposed on a parallel, outer side of the plurality of terminals in a longitudinal direction thereof and extending parallel to each other; and is adapted to position a pair of flat flexible cables widthwise therebetween and guide counterpart terminals of the flat flexible cables into place therebetween.

6. The connector according to claim 5, further including a cover member attached to the housing which covers a top surface thereof to thereby hold the flat flexible cables in place between the frame members.

7. The connector according to claim 6, wherein the housing further includes a flat base portion and a terminal accommodating recess formed therein.

8. The connector according to claim 5, wherein each frame member is provided with a guide portion for guiding counterpart terminals, located at the outermost positions, in an array direction of the counterpart terminals.

9. The connector according to claim 6, wherein the proximal ends are held by the terminal holding members.

10. The terminal assembly according to claim 2, wherein the frame member makes it possible to position the counterpart terminals in the array direction by bringing outer side surfaces of the counterpart terminals, positioned on the outermost positions, into contact with inner side surfaces of the guide portions.

11. The terminal assembly according to claim 3, wherein each terminal further includes an elastically deformable arm portion connecting the proximal ends.

12. The terminal assembly according to claim 11, wherein the elastically deformable arm portion comprises upwardly projecting angular projections connected to the proximal ends respectively.

13. The terminal assembly according to claim 11, wherein the elastically deformable arm portion further comprises a connecting portion connecting the angular projections, the angular projections coming into contact with the counterpart terminals.

14. The terminal assembly according to claim 4, wherein the terminal holding members cover the proximal ends of the plurality of terminals and at least a part of the frame members adjacent to both ends thereof.

15. The connector according to claim 7, wherein the housing further includes a pair of terminal holding member accommodating grooves each terminal holding member accommodating groove being formed in the terminal accommodating recess portion and receiving the terminal holding members.

16. The connector according to claim 15, wherein the housing further includes a pair of engaging projections, each engaging portion having:

an overhang portion, the overhand portion projecting inwardly toward a center of the housing and contacting an end portion of the flat flexible cables; and a cover latching portion, the cover latching portion projecting outwardly and engaging the engaging opening of the cover member.

17. The connector according to claim 8, wherein the frame members position the flat flexible cables widthwise by bringing outer side surfaces of the counterpart terminals, positioned at the outermost positions, into contact with inner side surfaces of the guide portions.

18. The connector according to claim 9, wherein each terminal includes an elastically deformable arm portion connecting the proximal ends.

19. The connector according to claim 18, wherein the elastically deformable arm portion comprises upwardly projecting angular projections connected to the proximal ends, respectively.

20. The connector according to claim 19, wherein the elastically deformable arm portion further comprises a connecting portion connecting the angular projections, the angular projections coming into contact with the counterpart terminals of a pair of flat flexible cables and holding the flat flexible cables in cooperation with the cover member, thereby allowing the flat flexible cables to be electrically connected to each other.

* * * * *